US011264752B1

(12) United States Patent
Durse et al.

(10) Patent No.: US 11,264,752 B1
(45) Date of Patent: Mar. 1, 2022

(54) PLANAR TERMINAL CONNECTOR HAVING AN ADDITIONAL CONTACT SPRING

(71) Applicant: Aptiv Technologies Limited, St. Michael (BB)

(72) Inventors: Nicholas A. Durse, Youngstown, OH (US); Michael L. Mellott, Youngstown, OH (US); Patrick J. Reedy, Youngstown, OH (US); Glenn E. Robison, Youngstown, OH (US)

(73) Assignee: APTIV TECHNOLOGIES LIMITED

( * ) Notice: Subject to any disclaimer, the term of this patent is extended or adjusted under 35 U.S.C. 154(b) by 0 days.

(21) Appl. No.: 17/092,810

(22) Filed: Nov. 9, 2020

(51) Int. Cl.
*H01R 13/11* (2006.01)
*H01R 13/115* (2006.01)

(52) U.S. Cl.
CPC ..... *H01R 13/115* (2013.01); *H01R 13/113* (2013.01)

(58) Field of Classification Search
CPC .. H01R 13/113; H01R 13/115; H01R 13/187; H01R 13/20–11/22
See application file for complete search history.

(56) References Cited

U.S. PATENT DOCUMENTS 7,766,706 B2 8/2010 Kawamura et al.
7,789,720 B2 9/2010 Zinn
8,628,335 B1 * 1/2014 Zhao ..... H01M 50/502 439/33
9,142,902 B2 9/2015 Glick et al.
9,153,889 B2 10/2015 Germ et al.
9,300,069 B2 3/2016 Morello et al.
9,537,227 B1 1/2017 Morello et al.
10,181,673 B1 * 1/2019 Hemnani ..... H01R 13/502
10,389,055 B1 * 8/2019 Lui ..... H01R 4/187

OTHER PUBLICATIONS

Terminal & Connectors Product Catalog Part II, Lear Corporation, Southfield MI, Oct. 1, 2008, pp. 82-85.

* cited by examiner

*Primary Examiner* — Vanessa Girardi
(74) *Attorney, Agent, or Firm* — Billion & Armitage

(57) ABSTRACT

An electrical connector assembly includes an elongate planar terminal extending along a first longitudinal axis having a connection end configured to interconnect the terminal to a corresponding elongate planar mating terminal extending along a second axis and an attachment end configured to attach the terminal to an electrical conductor. The electrical connector assembly also includes a contact spring configured to exert a normal force between the terminal and the mating terminal when the mating terminal is arranged between the contact spring and the connection end such that second axis is parallel to the first axis or when the mating terminal is arranged between the contact spring and the connection end such that the second axis is perpendicular to the first axis.

20 Claims, 9 Drawing Sheets

PLANAR TERMINAL CONNECTOR HAVING AN ADDITIONAL CONTACT SPRING

BACKGROUND

Right-angled electrical connector assemblies, such as those shown in U.S. Pat. No. 10,389,055 hereby incorporated by reference, have been used to make high power electrical connections between two planar terminals. This connector assembly typically has a female electrical connector having a planar terminal extending along a longitudinal axis and a resilient spring attached to the terminal by a retainer. A planar male mating terminal is placed between the terminal and the spring in a right-angled orientation to the female terminal. The arrangement of the spring and retainer cause the male terminal to be attached to the female terminal along a mating axis that is orthogonal to the longitudinal axis of the female terminal. If the male terminal were connected to the female terminal in a straight orientation, the arrangement of the spring and retainer still require a mating axis that is orthogonal to the longitudinal axis of the female terminal.

SUMMARY

According to one or more aspects of the present disclosure, an electrical connector assembly includes an elongate planar terminal extending along a first longitudinal axis having a connection end configured to interconnect the terminal to a corresponding elongate planar mating terminal extending along a second longitudinal axis and an attachment end configured to attach the terminal to an electrical conductor and a contact spring configured to exert a normal force between the terminal and the mating terminal when the mating terminal is arranged between the contact spring and the connection end such that second axis is parallel to the first axis or when the mating terminal is arranged between the contact spring and the connection end such that the second axis is perpendicular to the first axis.

In one or more embodiments of the electrical connector assembly according to the previous paragraph, the contact spring has bilateral symmetry.

In one or more embodiments of the electrical connector assembly according to any one of the previous paragraphs, the electrical connector assembly further includes a retainer having a first side wall attached to the connection end and a second side wall separated from and substantially parallel to the first side wall. The contact spring is disposed intermediate the second side wall and the connection end. The contact spring and the retainer are sized, shaped, and arranged to receive the mating terminal between the connect spring and the connection end along an insertion direction parallel to the first axis.

In one or more embodiments of the electrical connector assembly according to any one of the previous paragraphs, the contact spring defines a cantilevered plate having a fixed and a free end extending into a gap between the contact spring and the connection end. The cantilevered plate is sized, shaped, and arranged to exert the normal force between the terminal and the mating terminal when the second axis is parallel to the first axis or when the second axis is perpendicular to the first axis.

In one or more embodiments of the electrical connector assembly according to any one of the previous paragraphs, the contact spring is secured to the retainer by J-shaped tabs extending around edges of the second wall. The cantilever plate extends between two of the J-shaped tabs.

In one or more embodiments of the electrical connector assembly according to any one of the previous paragraphs, the cantilevered plate has an arcuate shape.

In one or more embodiments of the electrical connector assembly according to any one of the previous paragraphs, the second wall defines an aperture extending therethrough and the contact spring defines an arcuate fixed beam. The contact spring is secured to the retainer by the arcuate fixed beam being received within the aperture.

In one or more embodiments of the electrical connector assembly according to any one of the previous paragraphs, the arcuate fixed beam is configured to deflect and twist as the arcuate fixed beam is moved across the second wall from an edge of the second wall to the aperture. The arcuate fixed beam is configured to return to its original shape when the arcuate fixed beam is received within the aperture.

In one or more embodiments of the electrical connector assembly according to any one of the previous paragraphs, the connection end defines a plurality of oblong projections extending longitudinally along the connection end.

In one or more embodiments of the electrical connector assembly according to any one of the previous paragraphs, the plurality of oblong projections are nonparallel to the first axis.

In one or more embodiments of the electrical connector assembly according to any one of the previous paragraphs, one oblong projection in the plurality of oblong projections is arranged skew to another oblong projection in the plurality of oblong projections.

According to one or more aspects of the present disclosure, an electrical connector assembly includes an elongate planar terminal extending along a first longitudinal axis having a connection end configured to interconnect the terminal to a corresponding elongate planar mating terminal extending along a second longitudinal axis and an attachment end configured to attach the terminal to an electrical conductor. The electrical connector assembly further includes a retainer having a first side wall attached to the connection end and a second side wall separated from and substantially parallel to the first side wall. The second wall defines an aperture extending therethrough. The electrical connector assembly additionally includes a contact spring disposed intermediate the second side wall and the connection end and configured to exert a normal force between the terminal and the mating terminal. The contact spring defines an arcuate fixed beam securing the contact spring to the retainer by the arcuate fixed beam being received within the aperture.

In one or more embodiments of the electrical connector assembly according to the previous paragraph, the arcuate fixed beam is configured to deflect and twist as the arcuate fixed beam is moved across the second wall from an edge of the second wall to the aperture. The arcuate fixed beam is configured to return to its original shape when the arcuate fixed beam is received within the aperture.

In one or more embodiments of the electrical connector assembly according to any one of the previous paragraphs, the contact spring defines a cantilevered plate having a fixed and a free end extending into a gap between the contact spring and the connection end.

In one or more embodiments of the electrical connector assembly according to any one of the previous paragraphs, the contact spring is further secured to the retainer by J-shaped tabs extending around edges of the second wall. The cantilever plate extends between two of the J-shaped tabs.

In one or more embodiments of the electrical connector assembly according to any one of the previous paragraphs, the cantilevered plate has an arcuate shape.

In one or more embodiments of the electrical connector assembly according to any one of the previous paragraphs, the contact spring has bilateral symmetry.

In one or more embodiments of the electrical connector assembly according to any one of the previous paragraphs, the connection end defines a plurality of oblong projections extending longitudinally along the connection end.

In one or more embodiments of the electrical connector assembly according to any one of the previous paragraphs, the plurality of oblong projections are nonparallel to the first axis.

In one or more embodiments of the electrical connector assembly according to any one of the previous paragraphs, one oblong projection in the plurality of oblong projections is arranged skew to another oblong projection in the plurality of oblong projections.

According to one or more aspects of the present disclosure, an electrical connector assembly includes an elongate planar terminal extending along a longitudinal axis having a first end configured to interconnect the terminal to an elongate planar first electrical conductor and a second end configured to interconnect the terminal to a corresponding elongate planar mating electrical conductor. The electrical connector assembly also includes a first retainer and a second retainer each having a first side wall and a second side wall separated from and substantially parallel to the first side wall. The first retainer is attached to the first end and the second retainer is attached to the second end. The electrical connector assembly additionally includes a first contact spring disposed intermediate the second side wall of the first retainer and the first end and configured to exert a normal force between the terminal and the first conductor and a second contact spring, identical to the first contact spring, disposed intermediate the second side wall of the second retainer and the second end, and configured to exert a normal force between the terminal and the second conductor.

In one or more embodiments of the electrical connector assembly according to the previous paragraph, the first retainer is a mirror image of the second retainer.

DETAILED DESCRIPTION

This application is directed to an electrical connector assembly. The electrical connector assembly is designed so that a planar male blade terminal can be interconnected with a planar female terminal with a mating axis that is parallel to a longitudinal axis of the female terminal.

Figure 1:
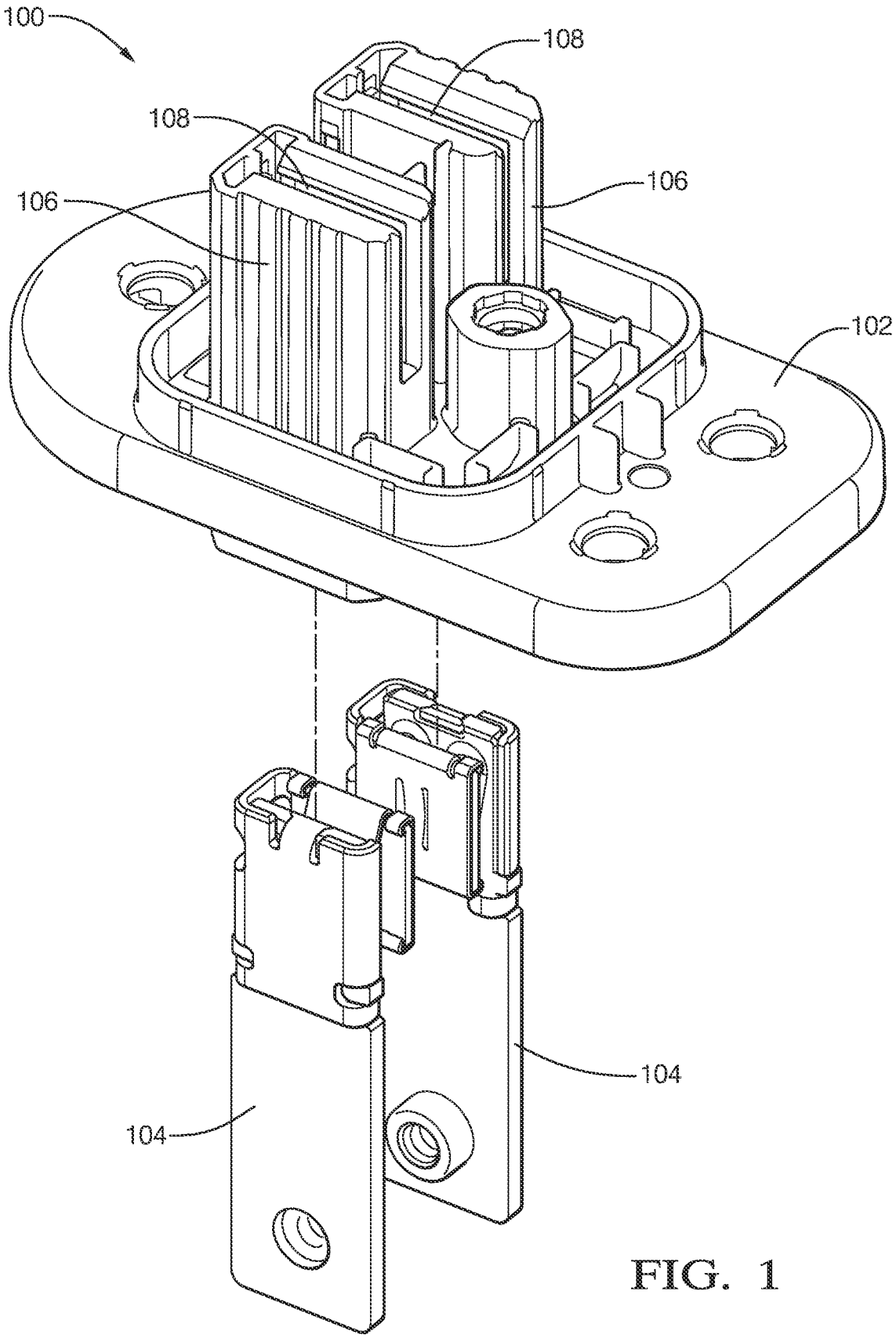
FIG. 1 is an exploded view of an electrical connector assembly.
Figure 2:
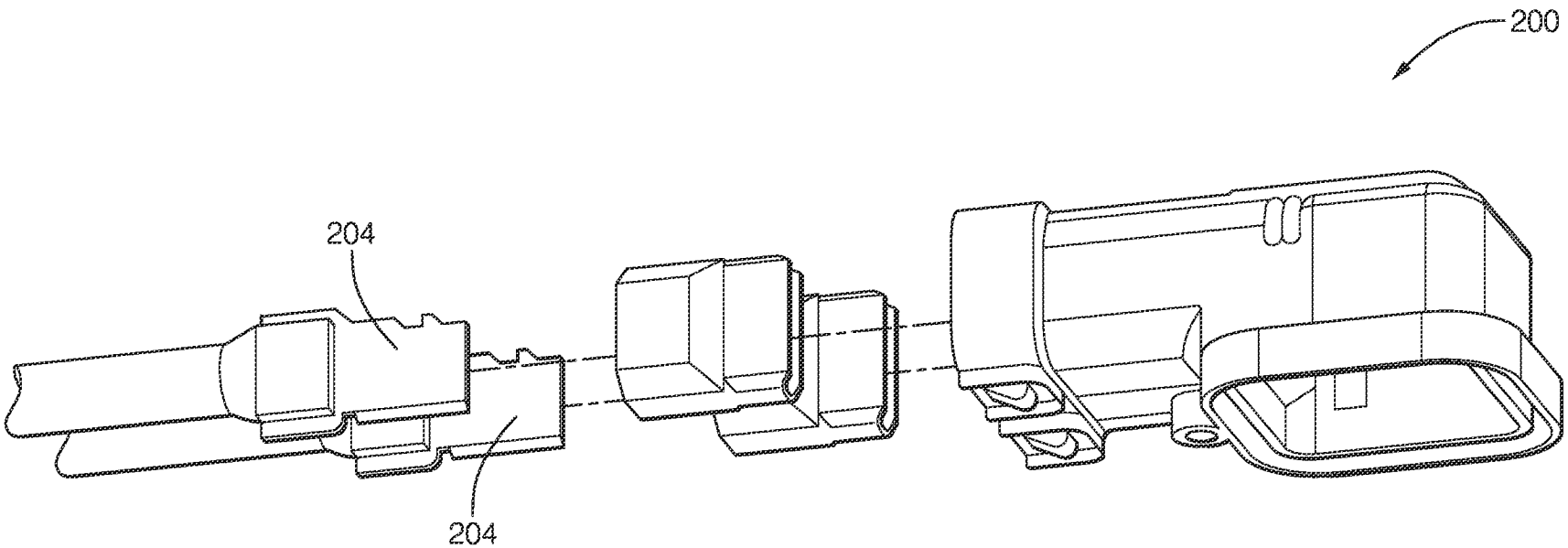
FIG. 2 is an exploded view of a mating connector assembly for the electrical connector assembly of FIG. 1.

FIG. 1 illustrates a non-limiting example of an electrical connector assembly, hereinafter referred to as the assembly 100. The assembly 100 includes an insulating header 102, which may be formed on a dielectric polymeric material that is designed to hold a pair of electrically conductive elongate planar terminals 104, which may be formed of a copper-based material, such as C11000. The illustrated header 102 is designed to be mounted to a panel (not shown), such as an electric vehicle battery case. The header 102 has a pair of terminal towers 106 defining terminal cavities (not shown) in which the pair of terminals 104 are disposed. Each terminal tower 106 has an opening 108 in the top of the tower that reaches down a side of each terminal tower 106 and extends into the terminal cavity. The assembly 100 also includes the pair of elongate planar terminals 104 that each extend along a longitudinal first axis X. Each terminal 104 has a connection end 110 configured to interconnect the terminal 104 to a corresponding elongate planar mating terminal 204 of a mating electrical connector assembly 200, see FIG. 2. The mating terminal 204 of the mating assembly 200 in FIG. 2 is arranged in a right-angled orientation to the terminal 104 of the assembly 100 of FIG. 1 and is received in the openings 108 of the terminal towers 106 along a mating axis that is parallel to the longitudinal axis X. The opening 108 in the top of the terminal tower 106 can also accommodate the mating terminal 204 when it is arranged in a straight orientation to the terminal 104 of the assembly 100 of FIG. 1.

Figure 3:
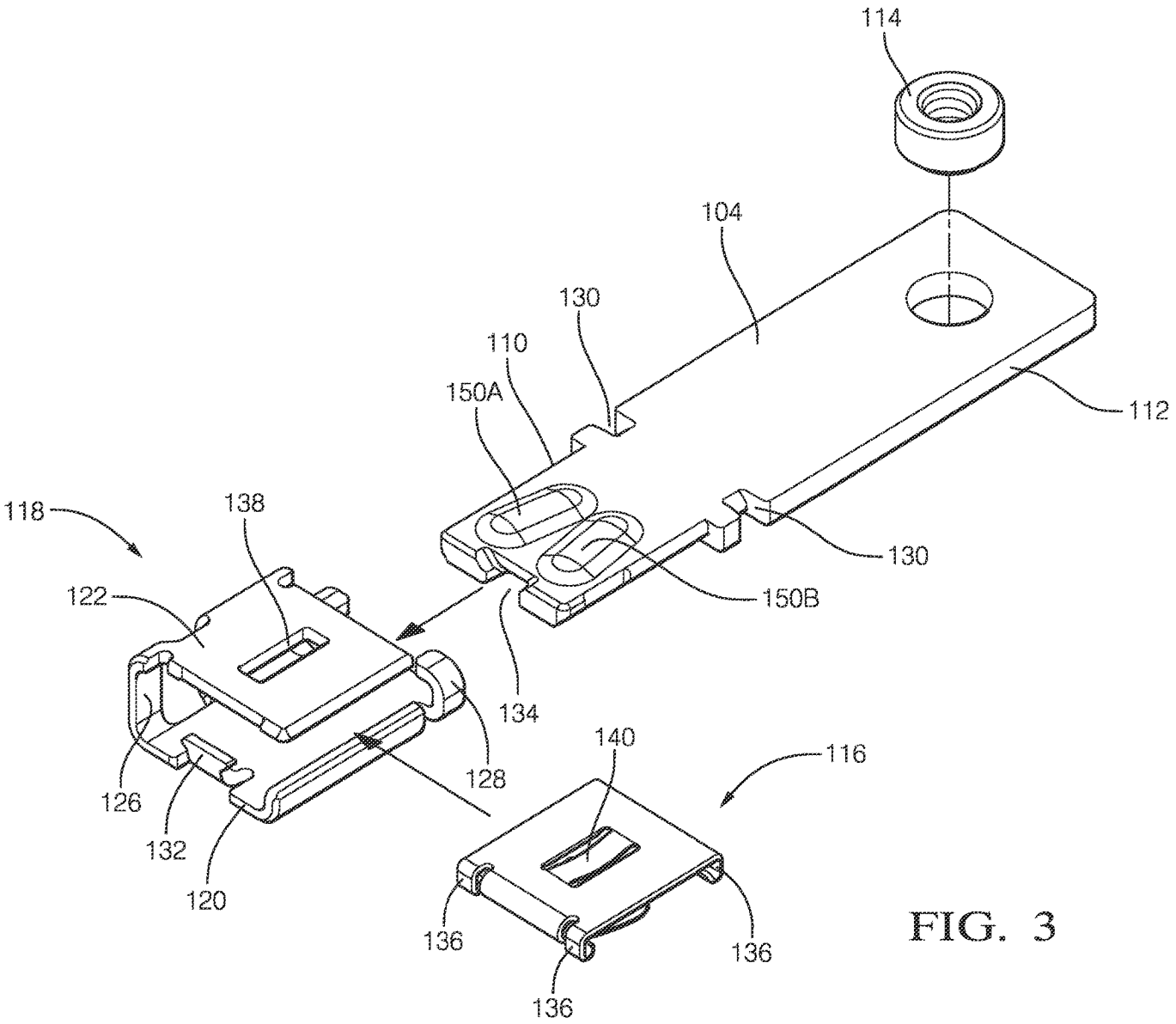
FIG. 3 is an exploded view of a terminal assembly of the electrical connector assembly of FIG. 1.

As shown in FIG. 3, each terminal 104 also has an attachment end 112 that is configured to attach the terminal 104 to an electrical conductor, such as a wire cable or bus bar (now shown). The attachment end 112 includes treaded nuts 114 on each of the terminals 104 that can be used to attach the terminal 104 to the electrical conductor, for example to a ring terminal of the wire cable or directly to the bus bar with a threaded bolt. In alternative embodiments, the electrical conductor is attached directly to the attachment portion using a welding process, such as sonic welding. The assembly also includes a contact spring 116 that configured to exert a normal force between the terminal 104 and the mating terminal 204 when the mating terminal 204 is arranged between the contact spring 116 and the connection end 110. The contact spring 116 is configured to exert the normal force on the terminal 104 and mating terminal 204 when the mating terminal 204 is arranged such that a longitudinal axis of the mating terminal 204 is parallel to the longitudinal axis X or when the mating terminal 204 is arranged such that the longitudinal axis of the mating terminal 204 is perpendicular to the longitudinal axis X. The contact spring may be formed from a stainless-steel material, such as SAE 301.

FIG. 3 further illustrates a U-shaped retainer 118 having a first side wall 120 that is attached to the connection end 110 and a second side wall 122 separated from the first side wall 120 by a gap 124. The second side wall 122 is substantially parallel to the first side wall 120. As used herein, "substantially parallel" means ±15° of being absolutely parallel. The retainer 118 also has an end wall 126 interconnecting the first and second side walls 120, 122. The retainer 118 may also be formed from a stainless-steel material, such as SAE 301.

The connection end 110 is located intermediate the first side wall 120 and the second side wall 122 of the retainer 118. The retainer 118 is attached to the terminal 104 by side tabs 128 extending from distal edges of the first side wall 120 that are received within side slots 130 defined in the distal edges of the attachment end 112 and crimped over the attachment end 112. The retainer 118 is further attached to the terminal 104 by an end tab 132 that extends from an end of the first side wall 120 and is received within an end slot 134 defined in the connection end 110 and is crimped over the connection end 110. The end tab has a dovetail shape that is received within the end slot. In other alternative embodiments, the retainer portion may be welded to the terminal portion, e.g. using a laser or resistance welding process.

Figure 7:
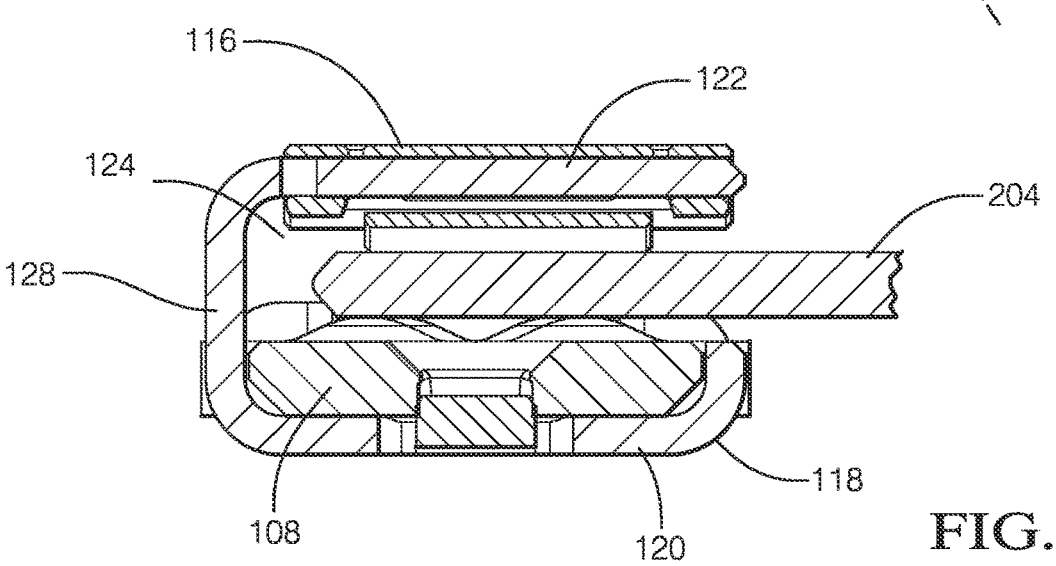
FIG. 7 is a cross-section view of the connected terminal assembly and a mating terminal of FIG. 5.

As shown in FIG. 3, the contact spring 116 is secured to the retainer 118 by J-shaped tabs 136 extending around opposed free edges of the second wall 122. The contact spring 116 is disposed intermediate the second side wall 122 and the connection end 110 as illustrated in FIG. 7. The contact spring 116 and the retainer 118 are sized, shaped, and arranged to receive the mating terminal 204 between the contact spring 116 and the connection end 110 along an insertion direction parallel to the longitudinal axis X.

Figure 10:
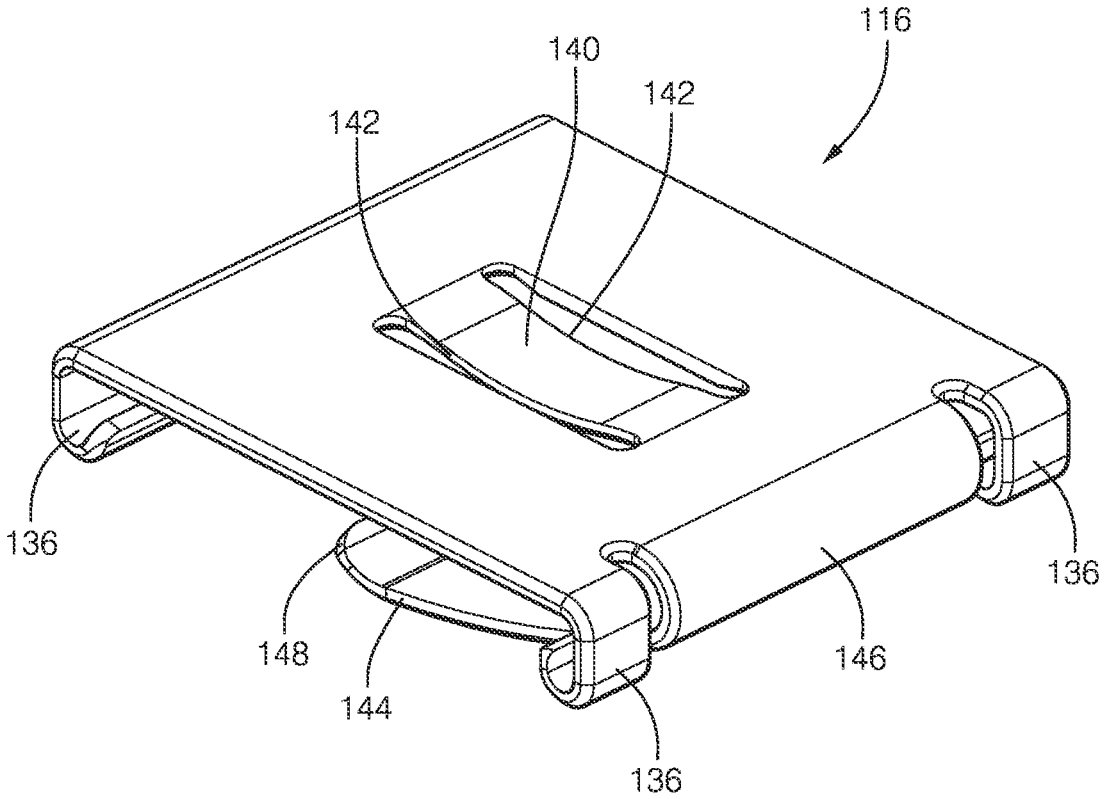
FIG. 10 is a perspective view of a contact spring of the terminal assembly of FIG. 2.

As shown in FIG. 3, the second side wall 122 defines a rectangular aperture 138 extending therethrough and as best shown in FIG. 10, the contact spring 116 defines an arcuate beam 140 that is fixed at both ends. The contact spring 116 is further secured to the retainer 118 by the arcuate fixed beam 140 being received within the aperture 138. The arcuate fixed beam 140 is configured to deflect and twist as the arcuate fixed beam 140 is moved across the second wall 122 from an edge of the second wall 122 to the aperture 138. The arcuate fixed beam 140 is configured to return to its original shape when the arcuate fixed beam 140 is received within the aperture 138. The arcuate fixed beam 140 is configured to deflect and twist as the arcuate fixed beam 140 is moved across the second wall 122 from an edge of the second wall 122 to the aperture 138. The arcuate fixed beam 140 is configured to return to its original shape when the arcuate fixed beam 140 is received within the aperture 138. Free edges 142 of the beam 140 are chamfered.

Figure 11:
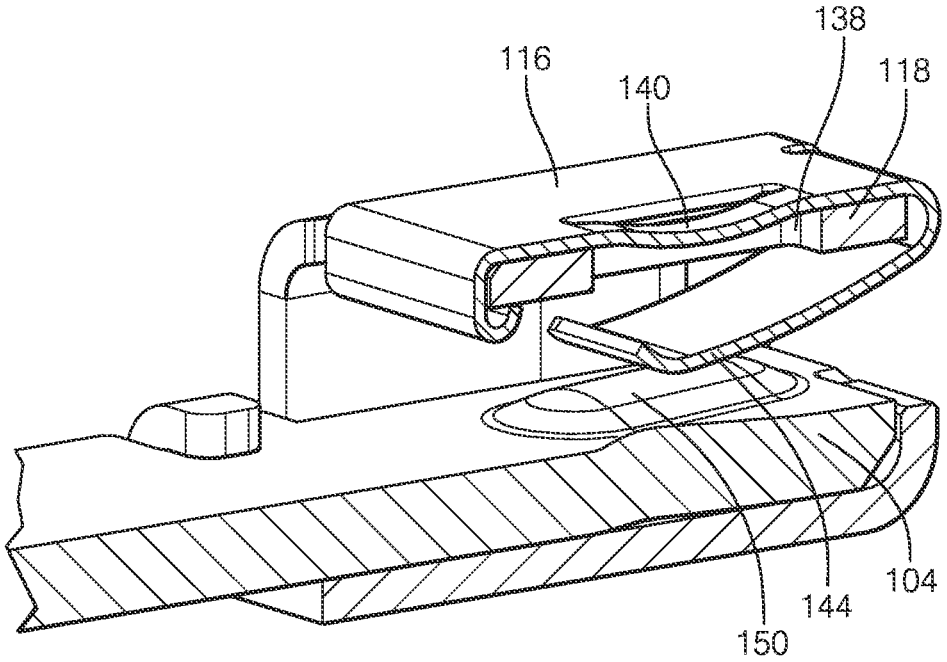
FIG. 11 is a cross-section perspective view of the terminal assembly of FIG. 2.

As shown in FIGS. 10 and 11, the contact spring 116 defines a cantilevered plate 144 having a fixed end 146 and a free end 148 extending into the gap 124 between the contact spring 116 and the connection end 110. The cantilevered plate 144 has an arcuate shape. The cantilevered plate 144 is sized, shaped, and arranged to exert the normal force between the terminal 104 and the mating terminal 204 when the longitudinal axis of the mating terminal 204 is parallel to the longitudinal axis X or when the longitudinal axis of the mating terminal 204 is perpendicular to the longitudinal axis X. The cantilever plate 144 extends between two of the J-shaped tabs 136. The retainer 118 and contact spring 116 are arranged such that an axis of mating the terminal 104 and the mating terminal 204 is parallel or coincident with the longitudinal axis X of the terminal 104.

Figure 4:
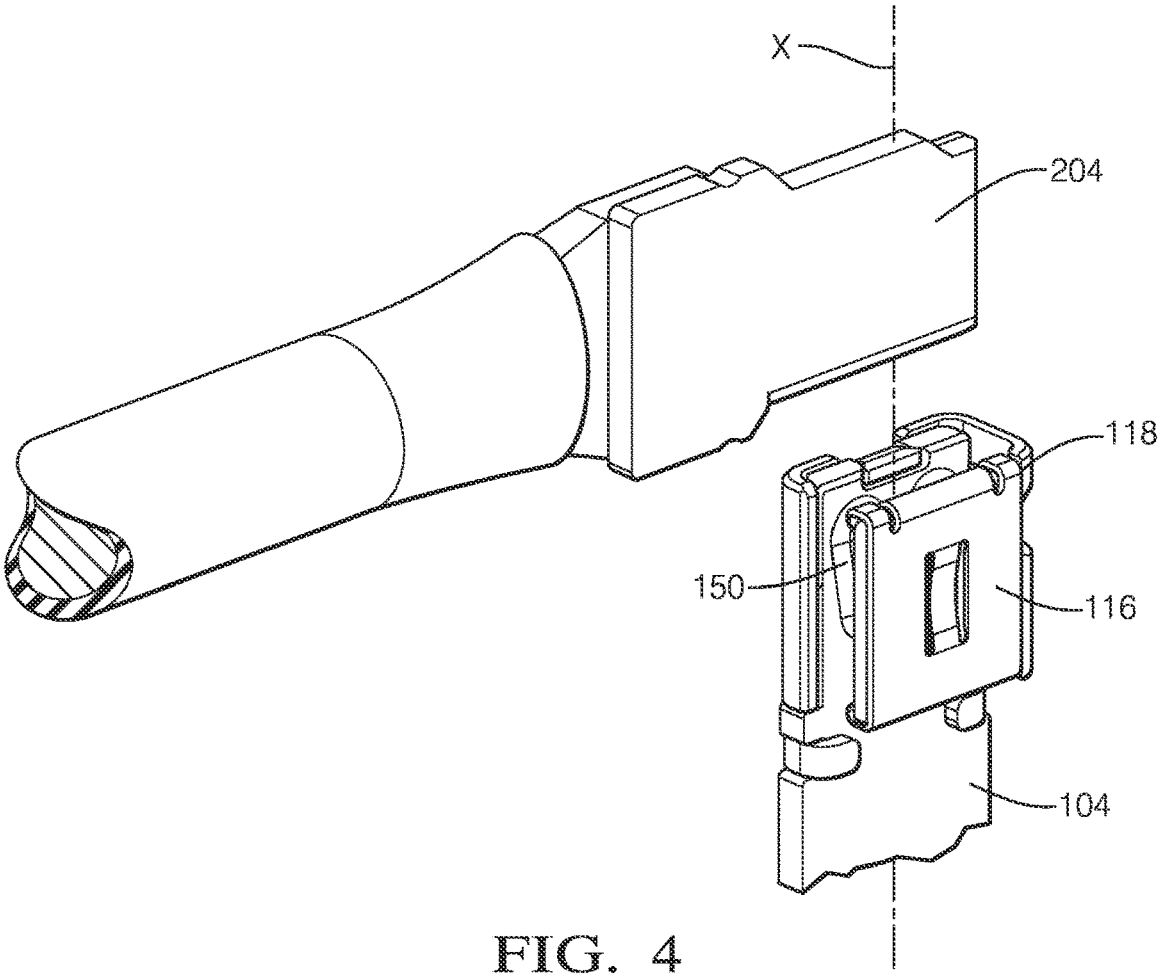
FIG. 4 is a pre-connection view of the terminal assembly of FIG. 2 and a mating terminal of the mating connector assembly of FIG. 3 in a right-angled configuration.
Figure 5:
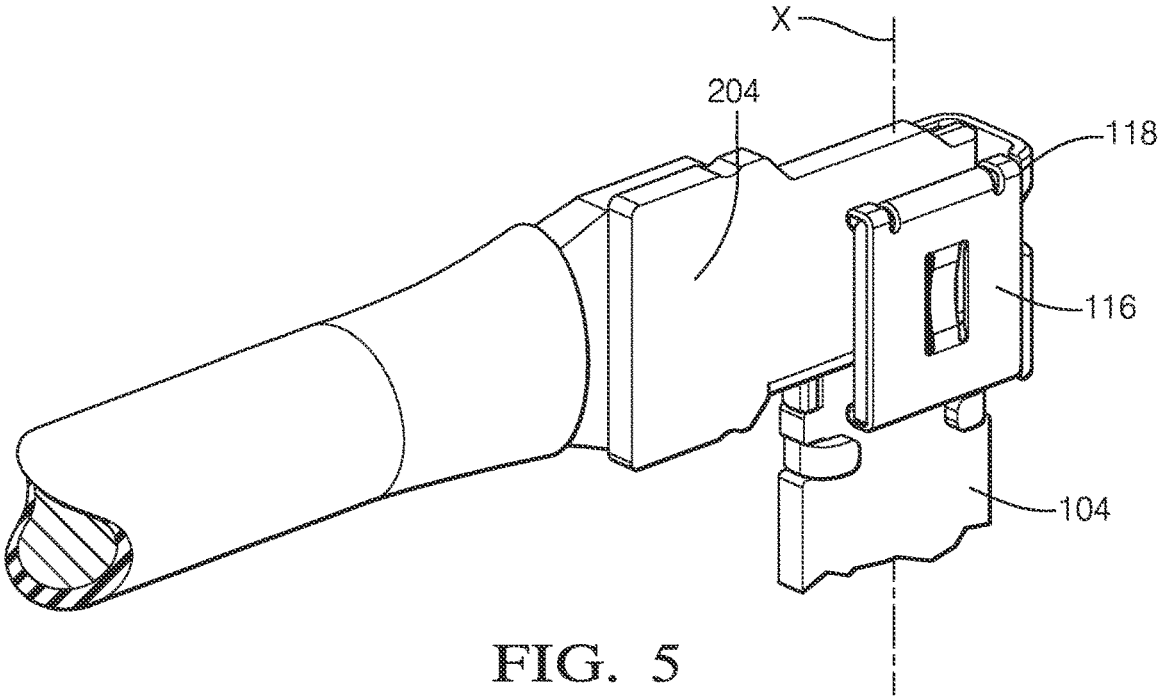
FIG. 5 is a post-connection view of the terminal assembly of FIG. 2 and a mating terminal of the mating connector assembly of FIG. 3 in a right-angled configuration.
Figure 6:
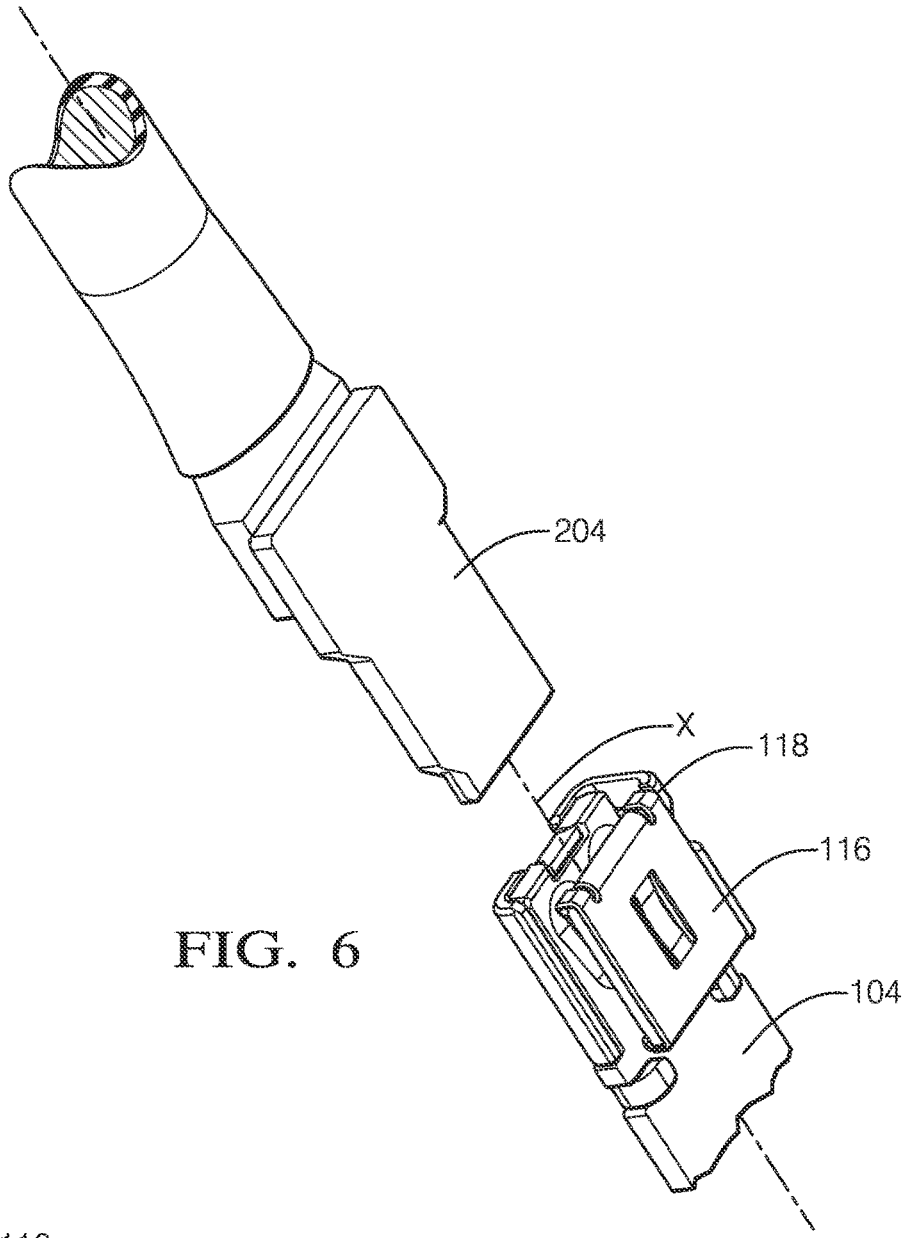
FIG. 6 is a pre-connection view of the terminal assembly of FIG. 2 and a mating terminal in a straight configuration.

The cantilevered plate 144 and the end wall 126 of the retainer 118 are arranged such that the mating axis of the terminal 104 with the mating terminal 204 is parallel or coincidental with the longitudinal axis X. Therefore, in cooperation with the openings 108 in the terminal towers 106, the assembly 100 can be mated with a mating connector assembly 200 with mating terminals 204 in either a right-angled configuration as shown in FIGS. 4 and 5 or a straight configuration as shown in FIG. 6.

Returning to FIG. 3, the connection end 110 of the terminal 104 defines a plurality of ridges or projections 150 having an oblong or stadium shape extending substantially longitudinally along the connection end 110. The projections 150 are configured to improve the electrical contact between the terminal 104 and the mating terminal 204. The projections 150 are arranged such that they are nonparallel to the longitudinal axis X. As used herein "nonparallel" means that a major axis and a minor axis of the oblong projections is at least 10 degrees from being parallel to the longitudinal axis X. One oblong projection 150 in the plurality of oblong projections 150 is canted or arranged skew to another oblong projection 150 in the plurality of oblong projections 150. It was discovered skewing or canting the projections 150 decreased wear of the terminals though numerous mating/unmating cycles. These projections 150 may be formed by an embossing process. While the connection end 110 of the terminal 104 in the illustrated example defines the protrusions, alternative embodiments of the assembly may be envisioned in which the mating terminal defines the plurality of protrusions.

Figure 8:
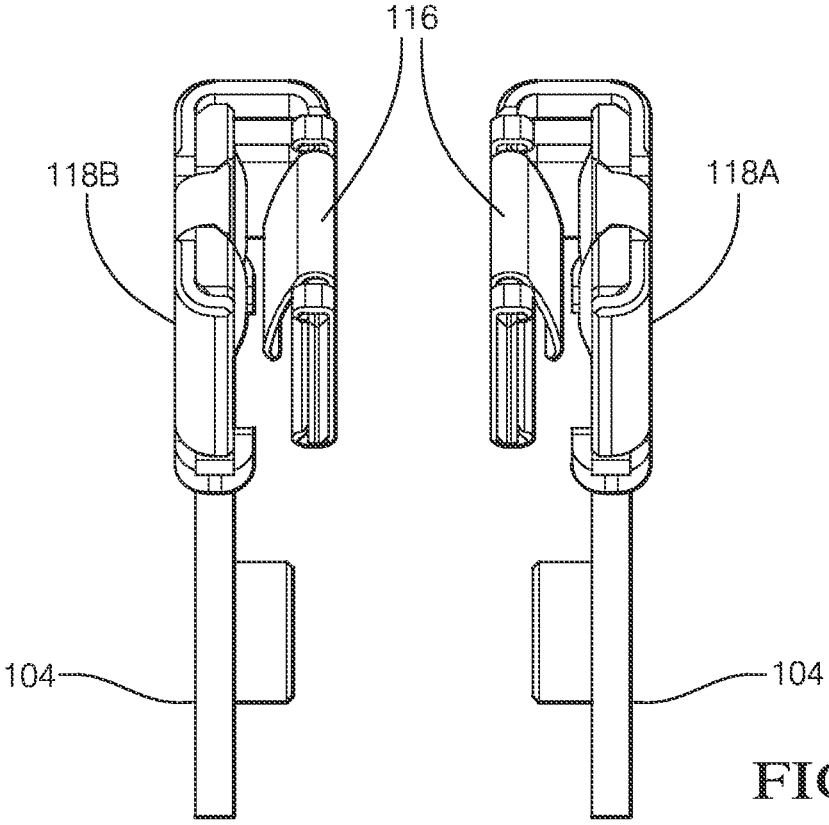
FIG. 8 is a perspective view of mirrored terminal assemblies.
Figure 9:
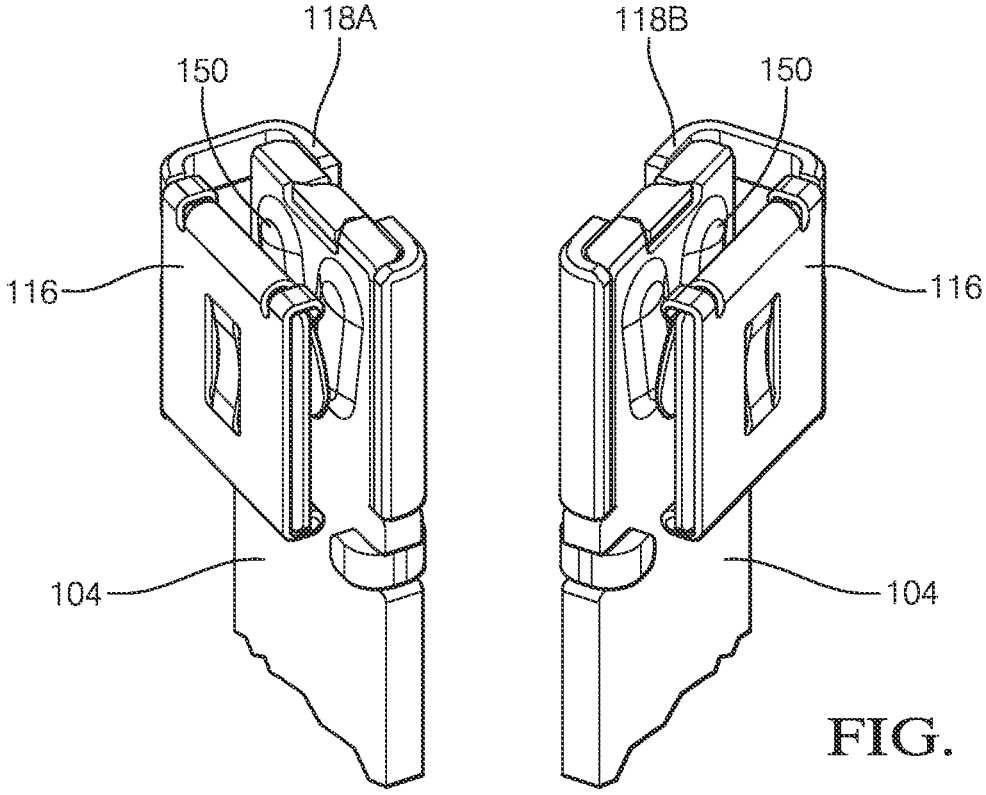
FIG. 9 is an alternative perspective view of mirrored terminal assemblies of FIG. 8.

The contact spring 116 and terminal 104 have bilateral symmetry about the longitudinal axis X of the terminal. This allows the same terminal 104 and spring 116 configuration to be used in either the right or left terminal cavity in the header 102 of the assembly 100 and further allows the mating axis with the mating terminal 204 to be parallel to the longitudinal axis X of the terminal. As illustrated in FIGS. 8 and 9, the first retainer 118A used in the right terminal cavity is a mirror image a second retainer 118B used in the left terminal cavity. This allows the retainers 118 and contact springs 116 to be both mounted inboard of the terminals 104, thereby allowing a reduction in the packaging size of the assembly 100 by 5 to 10 millimeters.

Figure 12:
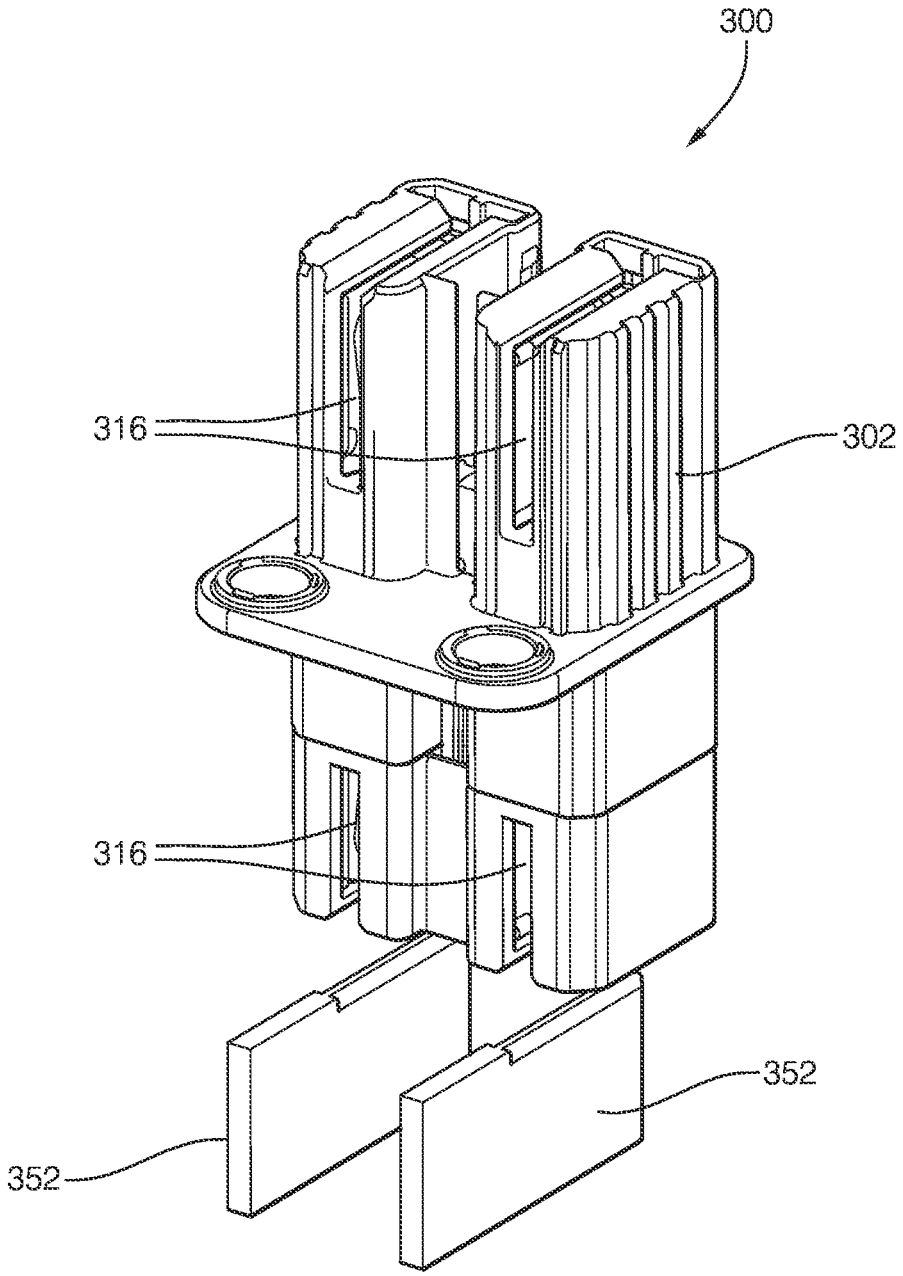
FIG. 12 is a perspective view of another electrical connector assembly.
Figure 13:
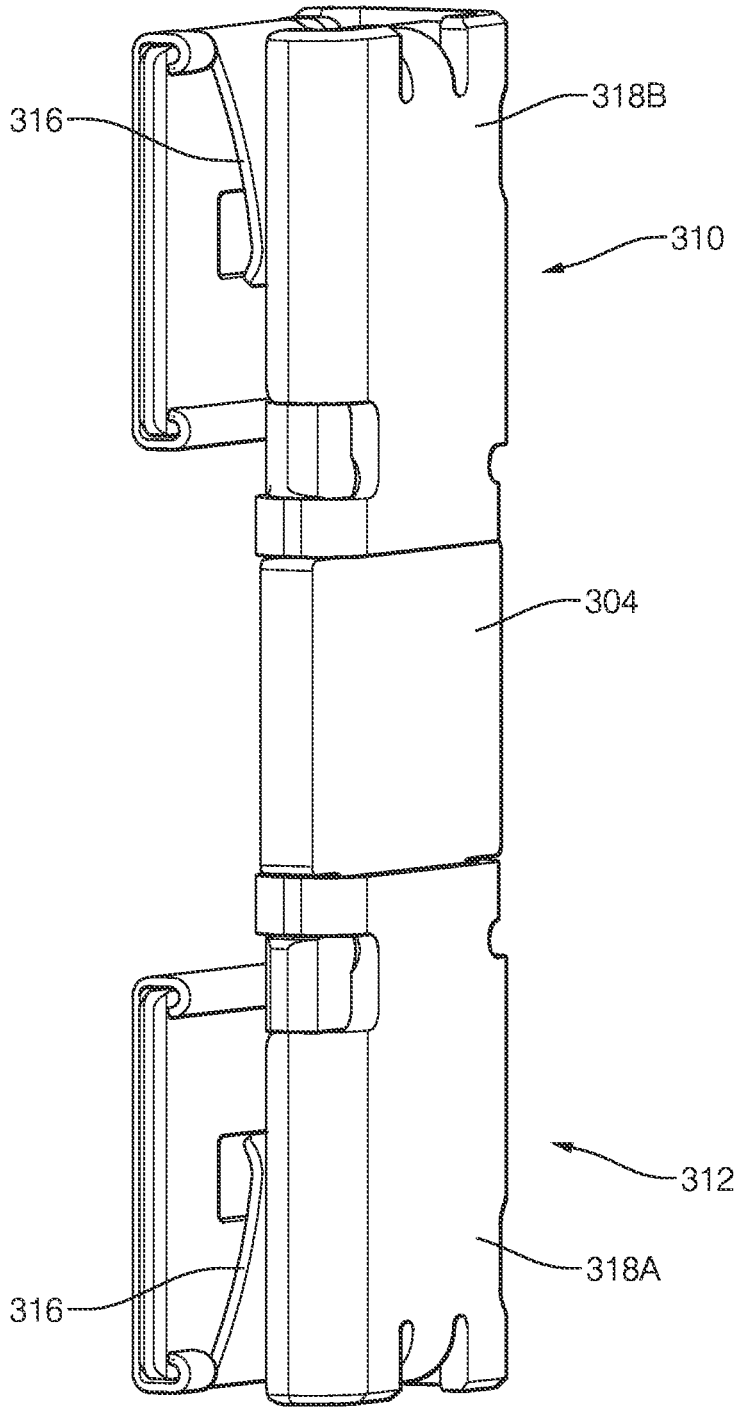
FIG. 13 is a perspective view of a terminal assembly of the electrical connector assembly of FIG. 12.

In another embodiment of the assembly 300 having a housing 302 shown in FIGS. 12 and 13, the attachment end 312 of the terminal 304 is configured to connect directly to a planar bus bar 352. As illustrated in FIG. 13, connection end 310 is the same as the connection end 110 of terminal 104 described above. The attachment end 312 includes a contact spring 316 identical to that of the connection end 310 of the terminal 304 described above and a retainer 318A that is a mirror image of the retainer 318B used to secure the contact spring 316 to the connection end 310. The attachment end 312 is also configured to receive the bus bar in a right-angled orientation to the terminal or in a straight configuration like the connection end. The connection end 310 and the attachment end 312 also defines canted protrusions (not shown) like those of the connection end 110 described above.

Without subscribing to any particular theory of operation, because the terminal 104 and the mating terminal 204 are in direct physical and electrical contact, the majority of the current flowing through the assembly 100 will flow thought these two components, therefore the electrical conductivity of the retainer 118 and the contact spring 116 are not critical to the current carrying capability of the assembly 100. Therefore, the material used for the retainer 118 and the spring 116 may be selected for their mechanical properties rather than their electrical properties, allowing the use of high temperature stainless steel materials like SAE301 or even a high temperature polymer material that can provide sufficient normal contact force between the terminal 104 and the mating terminal 204. These materials may provide the functionality needed from the retainer 118 and the spring 116 at a lower cost than a copper-based material, such as that used to form the terminal 204 and the mating terminal.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention is not limited to the disclosed embodiment(s), but that the invention will include all embodiments falling within the scope of the appended claims.

The invention claimed is:

1. An electrical connector assembly, comprising:

an elongate planar terminal extending along a first longitudinal axis having a connection end having a retainer attached thereto and configured to interconnect the terminal to a corresponding elongate planar mating terminal extending along a second axis and an attachment end configured to attach the terminal to an electrical conductor; and a contact spring attached to the retainer and configured to exert a normal force between the elongate planar terminal and the mating terminal when the mating terminal is arranged between the contact spring and the connection end such that second axis is parallel to the first axis or when the mating terminal is arranged between the contact spring and the connection end such that the second axis is perpendicular to the first axis, wherein the retainer has a first side wall attached to the connection end and a second side wall separated from and substantially parallel to the first side wall, wherein the contact spring is disposed intermediate the second side wall and the connection end, and wherein the contact spring and the retainer are sized, shaped, and arranged to receive the mating terminal between the connect spring and the connection end along an insertion direction parallel to the first axis and wherein the second wall defines an aperture extending therethrough and the contact spring defines an arcuate fixed beam and wherein the contact spring is secured to the retainer by the arcuate fixed beam being received within the aperture.

2. The electrical connector assembly according to claim 1, wherein the contact spring has bilateral symmetry.

3. The electrical connector assembly according to claim 1, wherein the arcuate fixed beam is configured to deflect and twist as the arcuate fixed beam is moved across the second wall from an edge of the second wall to the aperture and wherein the arcuate fixed beam is configured to return to its original shape when the arcuate fixed beam is received within the aperture.

4. The electrical connector assembly according to claim 1, wherein the contact spring defines a cantilevered plate having a fixed and a free end extending into a gap between the contact spring and the connection end and wherein the cantilevered plate is sized, shaped, and arranged to exert the normal force between the elongate planar terminal and the mating terminal when the second axis is parallel to the first axis or when the second axis is perpendicular to the first axis.

5. The electrical connector assembly according to claim 4, wherein the contact spring is secured to the retainer by J-shaped tabs extending around edges of the second wall and wherein the cantilever plate extends between two of the J-shaped tabs.

6. The electrical connector assembly according to claim 4, wherein the cantilevered plate has an arcuate shape.

7. The electrical connector assembly according to claim 1, wherein the connection end defines a plurality of oblong projections extending longitudinally along the connection end.

8. The electrical connector assembly according to claim 7, wherein the plurality of oblong projections is nonparallel to the first axis.

9. The electrical connector assembly according to claim 7, wherein one oblong projection in the plurality of oblong projections is arranged skew to another oblong projection in the plurality of oblong projections.

10. An electrical connector assembly, comprising:

an elongate planar terminal extending along a first longitudinal axis having a connection end configured to interconnect the elongate planar terminal to a corresponding elongate planar mating terminal extending along a second axis and an attachment end configured to attach the elongate planar terminal to an electrical conductor;

a retainer having a first side wall attached to the connection end and a second side wall separated from and substantially parallel to the first side wall, wherein the second wall defines an aperture extending therethrough; and a contact spring disposed intermediate the second side wall and the connection end and configured to exert a normal force between the elongate planar terminal and the mating terminal, wherein the contact spring defines an arcuate fixed beam securing the contact spring to the retainer by the arcuate fixed beam being received within the aperture.

11. The electrical connector assembly according to claim 10, wherein the arcuate fixed beam is configured to deflect and twist as the arcuate fixed beam is moved across the second wall from an edge of the second wall to the aperture and wherein the arcuate fixed beam is configured to return to its original shape when the arcuate fixed beam is received within the aperture.

12. The electrical connector assembly according to claim 10, wherein the contact spring has bilateral symmetry.

13. The electrical connector assembly according to claim 10, wherein the contact spring defines a cantilevered plate having a fixed and a free end extending into a gap between the contact spring and the connection end.

14. The electrical connector assembly according to claim 13, wherein the contact spring is further secured to the retainer by J-shaped tabs extending around edges of the second wall and wherein the cantilever plate extends between two of the J-shaped tabs.

15. The electrical connector assembly according to claim 13, wherein the cantilevered plate has an arcuate shape.

16. The electrical connector assembly according to claim 10, wherein the connection end defines a plurality of oblong projections extending longitudinally along the connection end.

17. The electrical connector assembly according to claim 16, wherein the plurality of oblong projections is nonparallel to the first axis.

18. The electrical connector assembly according to claim 17, wherein one oblong projection in the plurality of oblong projections is arranged skew to another oblong projection in the plurality of oblong projections.

19. An electrical connector assembly, comprising:

an elongate planar terminal extending along a longitudinal axis having a first end configured to interconnect the elongate planar terminal to an elongate planar first electrical conductor and a second end configured to interconnect the elongate planar terminal to a corresponding elongate planar mating electrical conductor;

a first retainer and a second retainer each having a first side wall and a second side wall separated from and substantially parallel to the first side wall wherein the first retainer is attached to the first end and the second retainer is attached to the second end;

a first contact spring attached to the first retainer and disposed intermediate the second side wall of the first retainer and the first end and configured to exert a normal force between the elongate planar terminal and the first conductor, wherein the second wall of the first retainer defines a first aperture extending therethrough and the first contact spring defines a first arcuate fixed beam and wherein the first contact spring is secured to the first retainer by the first arcuate fixed beam being received within the first aperture, and a second contact spring, identical to the first contact spring, attached to the second retainer, and disposed intermediate the second side wall of the second retainer and the second end, and configured to exert a normal force between the elongate planar terminal and the second conductor, wherein the second wall of the second retainer defines a second aperture extending therethrough and the second contact spring defines a second arcuate fixed beam and wherein the second contact spring is secured to the second retainer by the second arcuate fixed beam being received within the second aperture.

20. The electrical connector assembly according to claim 19, wherein the first retainer is a mirror image of the second retainer.

* * * * *